US005911659A

United States Patent [19]

Serano

[11] Patent Number: 5,911,659

[45] Date of Patent: Jun. 15, 1999

[54] GUTTER PROTECTOR

[75] Inventor: Kathleen Serano, Philadelphia, Pa.

[73] Assignee: Seranco, Philadelphia, Pa.

[21] Appl. No.: 08/839,506

[22] Filed: Apr. 14, 1997

[51] Int. Cl.[6] ..... E04D 13/064; E04D 13/076

[52] U.S. Cl. ..... 52/12; 52/11

[58] Field of Search ..... 52/11, 12

[56] References Cited

U.S. PATENT DOCUMENTS

| | | | |
|---|---|---|---|
| 546,042 | 9/1895 | Van Horn . | |
| 836,012 | 11/1906 | Cassens . | |
| 891,405 | 6/1908 | Cassen . | |
| 3,507,396 | 4/1970 | Homa | 52/12 X |
| 4,404,775 | 9/1983 | Demartini . | |
| 4,435,925 | 3/1984 | Jefferys . | |
| 4,455,791 | 6/1984 | Elko . | |
| 4,488,920 | 12/1984 | Marulic . | |
| 4,497,146 | 2/1985 | Demartini . | |
| 4,592,174 | 6/1986 | Hileman | 52/12 |
| 4,604,837 | 8/1986 | Beam . | |
| 4,607,465 | 8/1986 | Hopkins | 52/12 |
| 4,796,390 | 1/1989 | Demartini . | |
| 4,888,920 | 12/1989 | Marulic | 52/12 |
| 4,905,427 | 3/1990 | McPhalen | 52/12 |
| 5,181,350 | 1/1993 | Meckstroth . | |
| 5,459,965 | 10/1995 | Meckstroth . | |
| 5,522,013 | 5/1996 | Allen . | |
| 5,522,183 | 6/1996 | Allen | 52/12 |
| 5,595,027 | 1/1997 | Vail | 52/12 |

*Primary Examiner*—Christopher Kent
*Assistant Examiner*—Yvonne Horton-Richardson

[57] ABSTRACT

A gutter protector for preventing leaves and other debris from entering into a gutter that fits independently into standard gutter without fasteners such as nails or screws or any attachment to the roof, fascia or any other part of a building. The gutter protector consists of an inner wall which fits against the rear wall of standard gutter while seated upon the bottom wall of the gutter and a curved section that allows water to flow over the a flat section of the gutter protector through a uniform space between the gutter protector and the gutter created by a clip in the gutter protector that attaches to the gutter. The uniform space does not allow leaves or other debris larger than said uniform space to enter the gutter but maintains a space for a constant flow of water into the gutter.

6 Claims, 5 Drawing Sheets

GUTTER PROTECTOR

FIELD OF THE INVENTION

This invention relates to a gutter protector. In particular, this invention relates to a gutter protector that fits independently into standard gutters without fasteners such as nails or screws and deflects debris away from gutters while permitting water to flow into the gutters.

BACKGROUND OF THE INVENTION

Traditional gutters trap and accumulate debris from trees, animals and other sources. Accumulated debris severely reduces the ability of gutters to properly transfer water from the roof of a structure to locations away from the foundation of the structure, thereby defeating the fundamental purpose of gutters. Accordingly, debris accumulation in gutters necessitates periodic maintenance to remove debris and return gutters to operational condition.

Various attempts have been made to alleviate debris accumulation in gutters. Each attempt, however, has provided either expensive, impractical designs or fails to provide systems easily and securely integrated into standard, existing gutters.

None of the patents that follow are for gutter covers or protectors that fit independently into standard gutter without attachment to the roof or structure aid either failed to propose a gutter protector capable of maintaining a uniform space between the gutter protector and standard gutter, or proposed expensive, complicated, or impractical spacing methods: U.S. Pat. No. 4,404,775; U.S. Pat. No. 4,435,925; U.S. Pat. No. 4,497,146; U.S. Pat. No. 4,796,390; U.S. Pat. No. 5,181,350; U.S. Pat. No. 5,375,379; and U.S. Pat. No. 5,459,965. For example, the device proposed in the '775 patent either provides no manner for maintaining a constant water flow passage between the device and gutter, or requires a separate, complicated support bracket. Similarly, none of the devices in U.S. Pat. Nos. 181, 375 or 459 allow for a constant water flow into the gutter.

The following patents failed to propose a gutter protector capable of adequately protecting the gutter from debris accumulation and/or required fasteners; such as nails or screws to attach the gutter protector to the roof, fascia or other part of the structure to maintain the protective cover in place above the gutter and to provide a constant flows of water into the gutter: U.S. Pat. No. 546,042; U.S. Pat. No. 836,012; U.S. Pat. No. 891,405; U.S. Pat. No. 2,672,832; U.S. Pat. No. 4,455,791; U.S. Pat. No. 4,604,837; and U.S. Pat. No. 5,406,755. For example, the device proposed in the '042 patent would trap debris where the shield meets the gutter, thereby preventing water flow into the gutter. Of the above patents, the following require fasteners for attachment of the gutter protector to the roof, fascia or other portion of the structure in order to maintain the protective cover of the gutter protector above the gutter and to provide a constant flow of water into the gutter: '925, '837, and '755, Therefore, there is a great and thus unsatisfied demand for an inexpensive, uncomplicated, and effective gutter protector for use with standard gutters.

OBJECTS OF THE INVENTION

Accordingly, it is an object of The invention to overcome the problems associated with devices proposed in the prior art.

It is another object of the invention to provide a gutter protector made from one piece of material that is capable of deflecting debris away from the gutter while directing water flow into the gutter.

It is another object of the invention to provide a gutter protector that fits independently into standard gutters without the need for fasteners such as nails or screws for attachment to the roof, the fascia or any other part of the structure.

It is another object of the invention to provide a gutter protector which maintains a constant and adequate path for water flow into the gutter while deflecting debris away from the gutter.

Other objects of the invention will be apparent to one of skill in this art in view of the description that follows:

SUMMARY OF THE INVENTION

This invention provides a one-piece gutter protector which deflects debris away from the gutter while permitting water to flow into the gutter and fits independently into standard gutters without fasteners such as nails or screws for attachment to the roof, fascia or any other part of the structure. The gutter protector fits into a standard gutter and includes a rear portion which fits against at least a part of the rear wall of a standard gutter. The lower edge of the rear portion contacts the bottom wall of the gutter and a curved portion that extends to and above the lip of the gutter clips onto the lip and deflects debris away from the gutter but allows water to flow into the gutter.

The shape of the gutter protector maintains a constant and adequate path for water to flow from the roof into the gutter. A clip formed as part of the curved portion of the gutter protector enables the gutter protector to rest upon and be supported by a standard gutter and maintain a constant path for water to flow to the interior of the gutter independently without the need for separate and complicated brackets or fasteners such as nails or screws that are attached to the roof, fascia or any other part of the structure. The rear portion of the gutter protector fits against at least a portion of the rear wall of the gutter while contacting the bottom wall of the gutter and does not require attachment to the fascia, roof or structure to maintain the protective cover over the gutter while allowing a constant flow of water into the gutter.

DETAILED DESCRIPTION OF THE INVENTION

Figure 1:
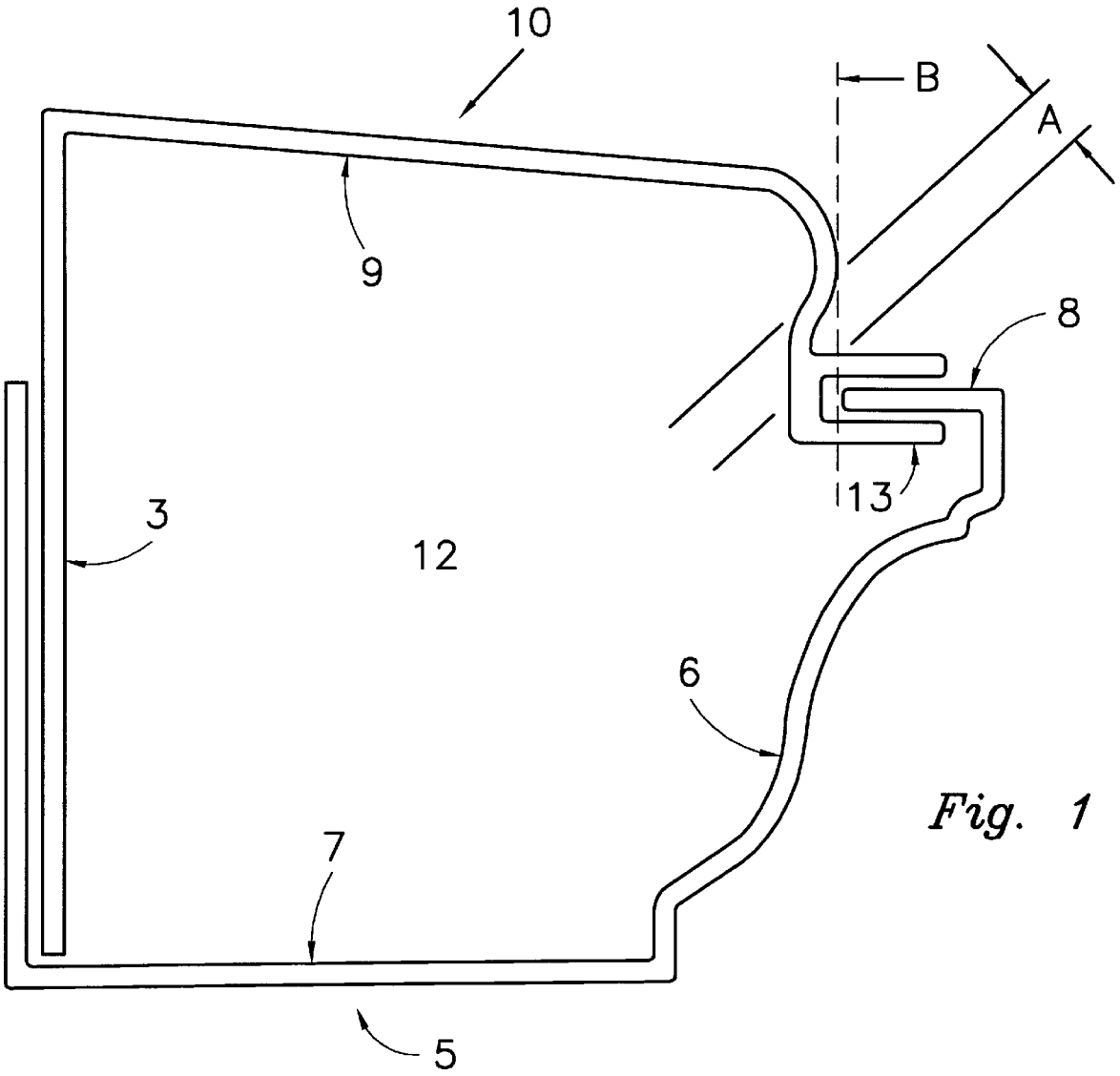
FIG. 1 is an alternative cross-sectional view of a gutter protector according to the invention shown seated in a standard gutter.

The following description is intended to refer to the specific embodiment illustrated in the drawings. This description is not intended to define or limit the scope of the invention which is defined separately in the claims that follow.

Referring to FIG. 1, the numeral "10" designates an embodiment of the gutter protector according to this invention. Gutter protector 10 is shown seated in the gutter designated by the numeral "5." Gutter 5 is a standard gutter trough commonly known and used in the commercial and residential building industry. Gutter 5 has an interior space designated "12," and is defined by a rear wall 11, an outer wall 6 which extends to lip 8 and a bottom wall 7 connecting rear wall 11 to outer wall 6.

Details of gutter protector 10 are described with reference to FIGS. 1, 2, 2A, 3, and 4 below:

FIG. 1 illustrates an important feature of the invention wherein a curved portion 1 of gutter protector 10 extends up to and above lip 8 curving toward the interior of the gutter and its final outward curve back toward lip 8 ending as clip 13 which attaches to lip 8. Curved Portion 1 allows water to flow over the gutter protector into gutter 5. This feature eliminates possible grooves, troughs, creases or channels between gutter protector 10 And the gutter where debris can collect. Space A is created above lip 8 of gutter 5 by the lowest extension of curved portion 1 designated clip 13 which attaches to lip 8, and secures gutter protector 10's position above lip 8 and maintains a space through which water can flow into the interior of the gutter.

Figure 2:
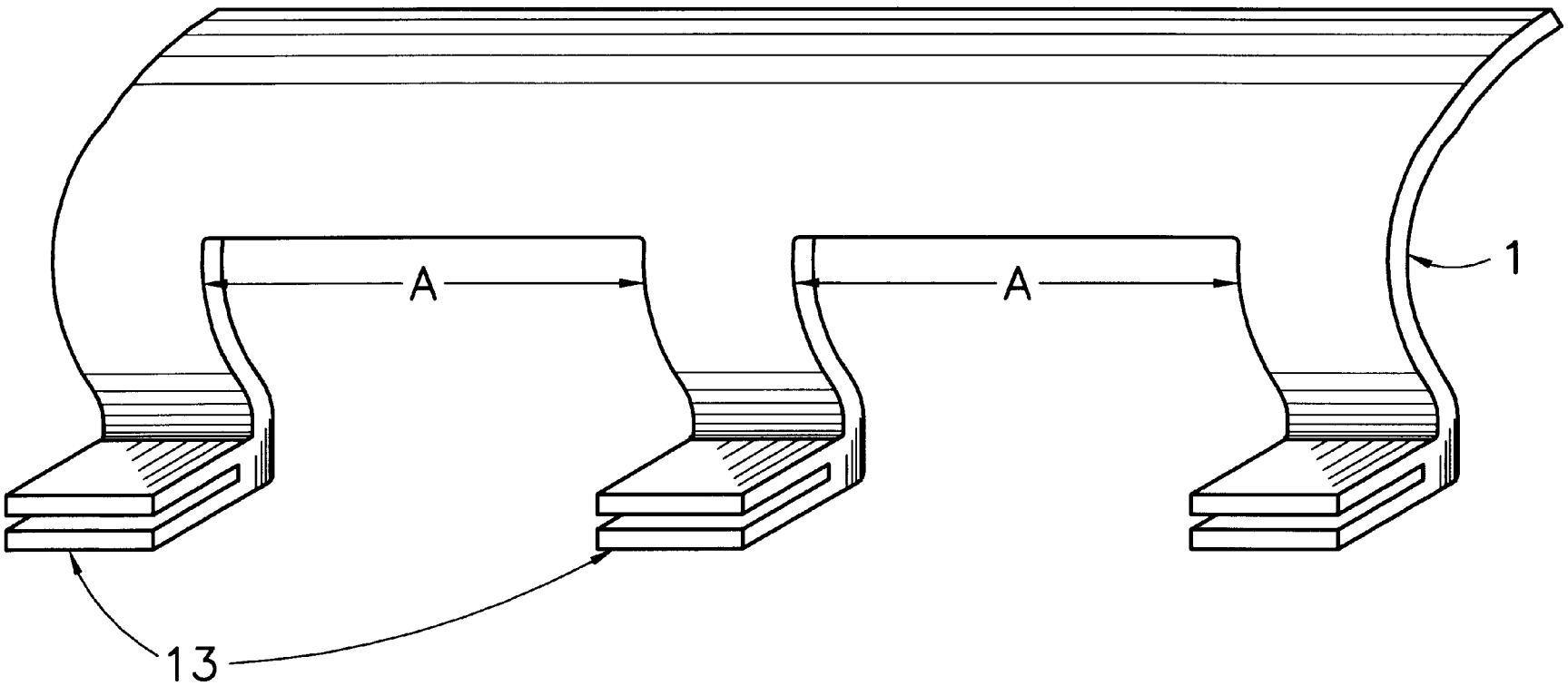
FIGS. 2 & 2A are front views of a clip which fits onto the outer edge or lip of a standard gutter and provides an opening for water to flow into the gutter.
Figure 2A:
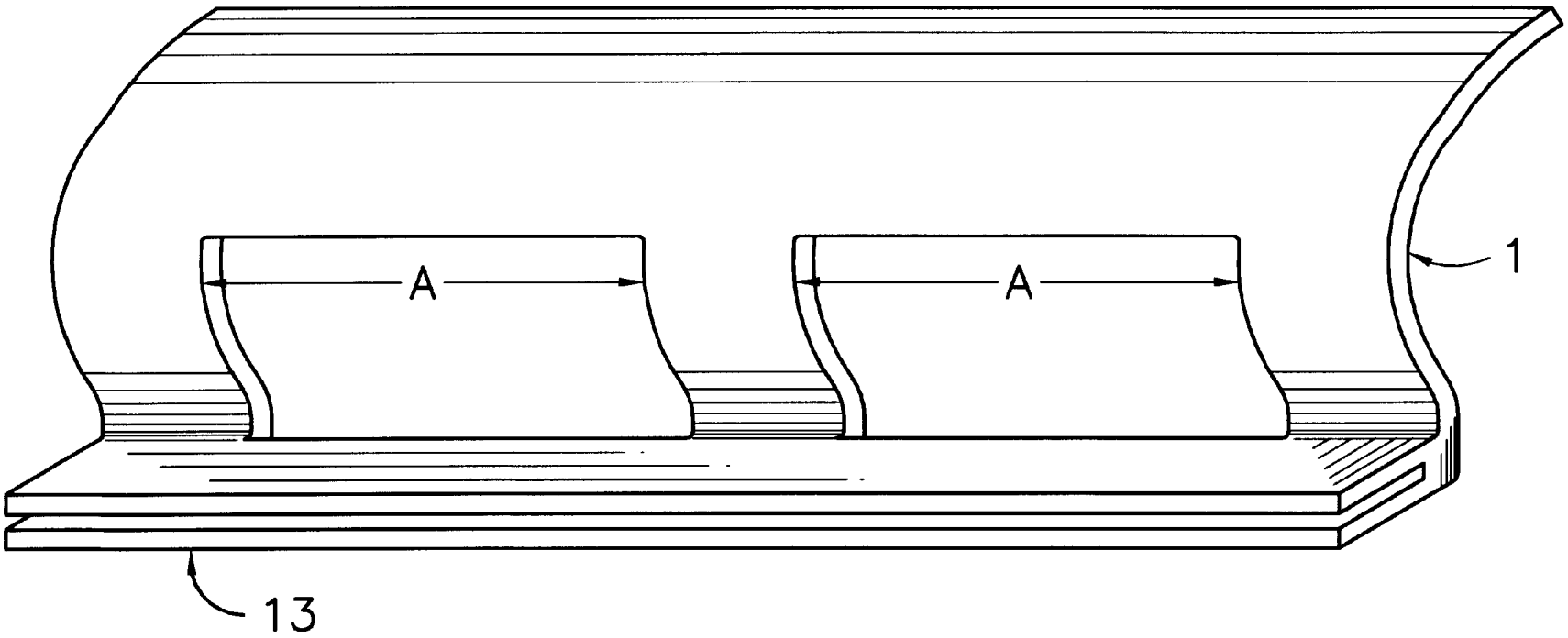

Alternatively, clip 13 may be formed along the lower longitudinally extending edge of curved portion 1 as illustrated in FIG. 2*a*. The smooth surface of flat portion 9 maintains the flow of water from rear portion 3 to curved portion 1. The outermost extent of curved portion 1 over gutter 5 coincides with the inner edge of lip 8 at dashed line B so that water following the contour of curved portion 1 flows into the gutter. However, debris such as leaves and tree branches larger than space A is deflected away from the gutter because said debris cannot physically pass through space A into the gutter. Debris small enough to travel with water through said space A passes harmlessly with the water into the gutter and through the entire roof drainage system. Space A created bit the curvature of curved portion 1 allows water flowing along flat portion 9 to contour and fall over curved portion 1 of gutter protector 10 into gutter 5.

FIGS. 2 & 2A are alternate front views illustrating two variations of curved portion 1 of gutter protector 10 which depict space A and clip 13. Utilization of either variation depends upon the manufacturer's preference. If plastic is used to form gutter protector 10, gutter protector 10 will easily be strong enough to support the weight of the environmental elements such as snow, ice and rain.

Figure 3:
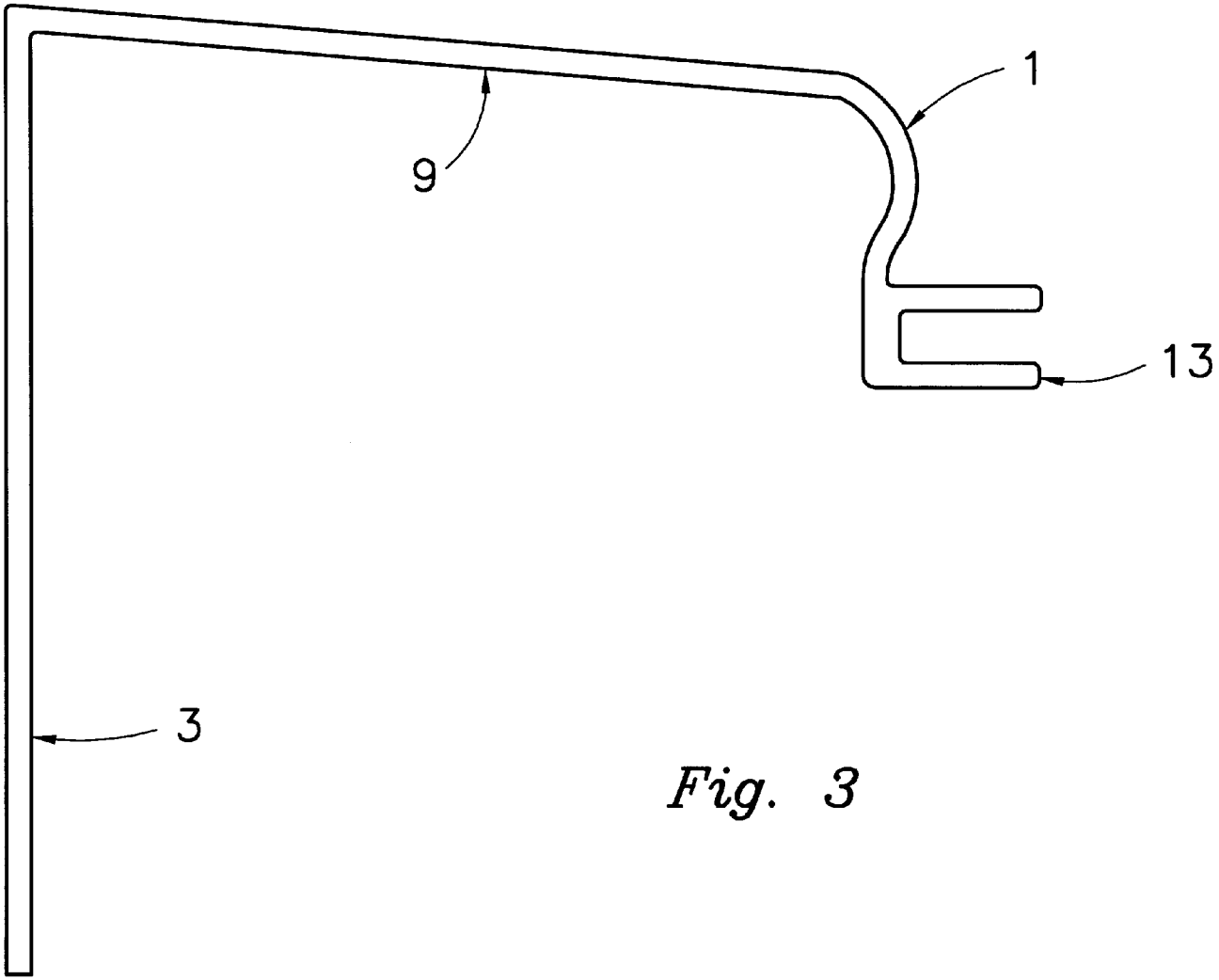
FIG. 3 is a side view of the gutter protector shown in FIG. 1.

FIG. 3 shows gutter protector 10 from the side, illustrating its important contour. Specifically, FIG. 3 shows gutter protector 10's rear portion 3 and its slightly greater than 90 degree angle to flat portion 9 which proceeds laterally to and above the gutter becoming curved portion 1 which curves toward the interior of the gutter and then curves outwardly forming clip 13. The angle where rear portion 3 meets flat portion 9 is slightly greater than 90 degrees in order to create tension between gutter protector 10's points of contact with gutter 5 at bottom wall 7 and lip 8.

Figure 4:
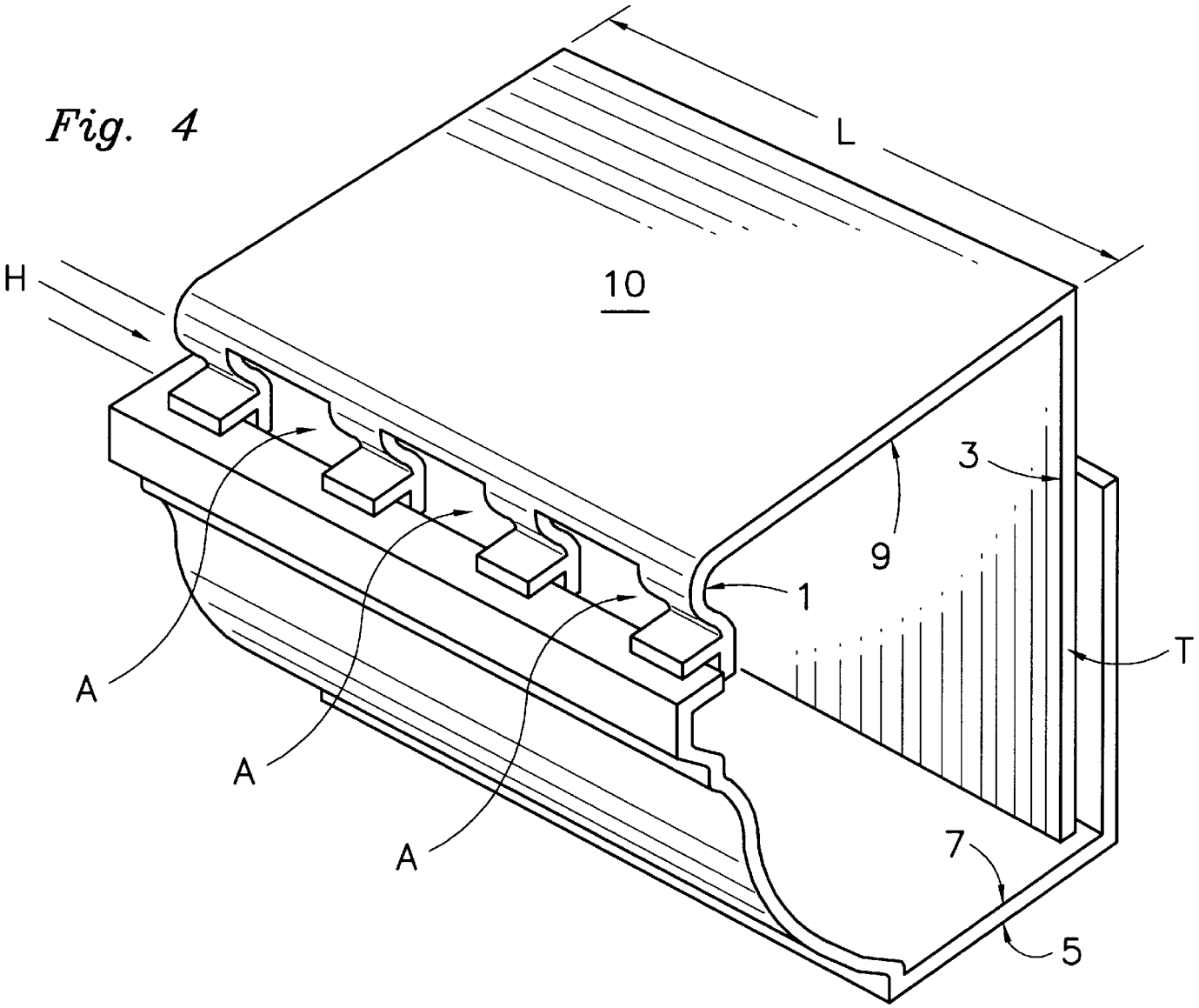
FIG. 4 is a perspective view of a gutter protector according to this invention shown positioned in a standard gutter.

Referring to FIG. 4, gutter protector 10 has an overall length L which preferably corresponds to the length of gutter 5 in which gutter protector 10 independently fits. The upper portion of rear portion 3 angles and extends laterally as flat portion 9 toward curved portion 1. Gutter protector 10 has a thickness of T sufficient to provide a rigid surface capable of withstanding environmental elements such as wind, ice and snow. Curved portion 1 creates height H forming space A through which water may continuously flow into the gutter. Flat portion 9 and curved portion 1 of gutter protector 10 most preferably have a smooth surface.

Gutter protector 10 is preferably formed from malleable materials such as plastic, fiberglass;, composite material or other suitable ultraviolet resistant materials, depending upon the manufacturer's preference. However gutter protector 10 is optionally formed from aluminum, copper, stainless steel, alloys or other metallic materials commonly used in building gutter systems.

Installation and operation of gutter protector 10 will now be described with reference to FIGS. 1–4. As one contiguous piece, gutter protector 10 fits independently into standard gutter without fasteners for attachment to the fascia, roof or any other part of the structure. Alternately, rear portion 3 may fit against any portion of rear wall 11 or may not contact rear wall 11 at all. However, the lower longitudinally extending edge of rear portion 3 must contact bottom wall 7 of gutter 5. Two parts of gutter protector 10 contact gutter 5: (1) rear portion 3 contacts at least a part of rear wall 11 of gutter 5 while contacting bottom wall 7 of gutter 5 and (2) clip 13 of curved portion 1 contacts lip 8 of gutter 5. Gutter protector 10 is held in place by the force of gravity on the two contact points as well as the tension between rear portion 3's contact with at least a part of rear wall 11 and its contact with bottom wall 7 and the attachment of clip 13 to lip 8 of gutter 5. These two contact points provide a strong and stable union with the cutter that is stationary and easily capable of withstanding the environmental elements of wind, rain, snow and ice.

Leaves and other debris washed by water from the roof onto gutter protector 10 seated independently in gutter 5 as illustrated in FIGS. 1 & 4 are deflected away from lip 8 because of the limitations of space A created by height H. Water continuously flows over curved portion 1 of gutter protector 10 through space A created by height H into gutter 5; however, leaf fragments and debris larger than space A are deflected away from gutter 5. The following Example exemplifies the operation of a gutter protector according to this invention:

EXAMPLE

A gutter protector according to this invention was formed from Polyvinyl Chloride or PVC having a thickness of 0.085 centimeters and length of 48 inches,

- a rear portion fitting against at least a part of the rear wall of a standard gutter measured 4 ¾ inches and was seated upon the bottom wall of a standard gutter,
- flat portion 9 proceeded laterally from the upper portion of the rear portion to curved portion 1 and had an approximate length of 5 inches,
- curved portion 1's inward curve had a diameter of approximately ½ inch and its outward curve had a diameter of ½ inch with clip 1 attached to lip 8.

The gutter protector was inserted into standard gutter of a roof and tap water from a hose was supplied to the roof at progressively greater flow rates of 30 gallons per hour, 45 gallons per hour, 60 gallons per hour, 90 gallons per hour and 120 gallons per hour. These flow rates represent the flow of rainwater over the four foot length of the gutter protector. Even at the highest rate of 120 gallons per hour per four foot section of gutter protector, simulated rainwater followed the contour of curved portion 1 and flowed into the gutter. This indicates that rainwater, even during severe thunderstorms, will follow the contour of the gutter protector and flow through the space designated space A created by height H of curved portion 1 into the gutter while debris larger than ⅜ inch is deflected away from the gutter.

If desired, changes and modifications can be made to the illustrated embodiment of this invention without departing from its spirit and scope. For example, clip 13 may contact lip 8 longitudinally with space for water flowing into the gutter through openings in the outermost curve of curved portion 1 formed at selected intervals as illustrated in FIG. 2A. Gutter protector 10 may be manufactured with varied dimensions of thickness and height above the gutter, so long as space is provided for water to flow into the gutter.

The present invention, in any embodiment, provides an inexpensive device for reliably preventing debris accumulation in standard gutters. The invention is inexpensive to manufacture, simple to install, and dependable in use. Because of its unique one-piece construction and its independent fit into standard gutter systems without the need for fasteners of any kind for attachment to the fascia, roof or any other part of the structure, installation is accomplished by simply inserting the gutter protector directly into standard gutter with clip 13 attaching lip 8 and rear portion 3 seated upon bottom wall 7 of gutter 5.

What is claimed is:

1. A gutter protector that fits independently into a gutter without fasteners and is adapted to prevent debris from a roof of a building from entering a gutter and permit flow of water from said roof of said building into said gutter, said gutter having an interior defined by a rear wall, an outer wall having an upper lip, an a bottom wall connecting said rear wall to said outer wall said gutter protector comprising:

a rear portion adapted to fit against at least a portion of the rear wall of the gutter and having a lower edge positioned on said bottom wall;

a flat portion extending laterally from an upper edge of said rear portion and adapted to receive said water flowing from said roof and being sloped horizontally to transfer said water away from said roof and into said gutter;

a curved portion extending downwardly from said flat portion to and above said upper lip and curving toward said interior to receive water from said flat portion and transfer said water to said interior; and at least one clip projecting from said curved portion and being shaped to attach onto said upper lip to provide support for said curved portion and to define a space above said gutter for said water to flow from said curved portion into said interior.

2. A gutter protector comprising:

a longitudinally extending rear portion that fits against at least a portion of a rear wall of a gutter and having a lower edge seated upon a bottom wall of said gutter;

a flat portion extending from an upper edge of said rear portion to and above a lip extending from an outer wall of said gutter;

a curved portion extending from said flat portion to and above said lip and curving toward an interior of said gutter; and at least one clip projecting from said curved portion, said at least one clip being located substantially transverse to the length of said gutter protector and shaped to attach to said lip to provide support for said curved portion and to define a space above said gutter for water to flow from said curved portion into said gutter.

3. A gutter protector described in claim 2 wherein said rear portion does not contact said inner wall of said gutter and with the lower edge of said rear portion contracting on said bottom wall.

4. The gutter protector described in claim 2, further comprising an outwardly curved end portion extending from said curved portion above the gutter into said water-receiving space in said gutter said outwardly curved end portion is adapted to clip onto the lip of the gutter to allow water to flow into the gutter through openings placed at regular intervals along the outwardly curved end portion.

5. The gutter protector described in claim 2, wherein said at least one clip project outwardly from at least a portion of said curved portion of said gutter protector, and said at least one clip shaped to attach onto the lip of said outer wall of said gutter to provide support for said gutter protector and to provide a space for rainwater to flow over said curved portion and into the interior of said gutter.

6. A gutter protector adapted to fit into a gutter without fasteners and is adapted to prevent debris from a roof of a building from entering a gutter and permits the flow of water from said roof of said building into said gutter, said gutter having an interior defined by a rear wall, a bottom wall and an outer wall having an upper lip, the gutter protector comprising:

a substantially upright rear portion adapted to fit against at least a portion of the rear wall of said gutter;

a flat portion extending laterally from an upper edge of said rear portion and adapted to receive water flowing from said roof and being sloped horizontally to transfer said water away from said roof and into said gutter;

an outwardly curved portion extending downwardly from said flat portion to and above said upper lip of said gutter and curving toward said interior to receive water from said flat portion and transfer said water to said interior of said gutter through openings placed at selected intervals along said outwardly curved portion; and a clip projecting from said curved portion and being shaped to attach onto said upper lip of said gutter to provide support for said outwardly curved portion and to define a space above said gutter for water to flow from said outwardly curved portion into the interior of said gutter.

* * * * *